US009289889B2

(12) United States Patent
Pettersson et al.

(10) Patent No.: US 9,289,889 B2
(45) Date of Patent: Mar. 22, 2016

(54) HYDRAULIC IMPACT MECHANISM FOR USE IN EQUIPMENT FOR TREATING ROCK AND CONCRETE

(75) Inventors: Maria Pettersson, Stora Mellösa (SE); Anders Johansson, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 548 days.

(21) Appl. No.: 13/261,579

(22) PCT Filed: Jul. 1, 2011

(86) PCT No.: PCT/SE2011/050898

§ 371 (c)(1), (2), (4) Date: Jan. 29, 2013

(87) PCT Pub. No.: WO2012/030272

PCT Pub. Date: Mar. 8, 2012

(65) Prior Publication Data

US 2013/0186667 A1 Jul. 25, 2013

(30) Foreign Application Priority Data

Aug. 31, 2010 (SE) ..... 1000885

(51) Int. Cl.

| | |
|---|---|
| ***B25D 9/14*** | (2006.01) |
| ***B25D 9/18*** | (2006.01) |
| ***B25D 17/24*** | (2006.01) |
| ***E21B 1/00*** | (2006.01) |
| ***F15B 21/12*** | (2006.01) |
| ***B25D 9/12*** | (2006.01) |

(52) U.S. Cl.

CPC *B25D 9/145* (2013.01); *B25D 9/12* (2013.01); *B25D 9/18* (2013.01); *B25D 17/245* (2013.01); *E21B 1/00* (2013.01); *F15B 21/12* (2013.01); *B25D 2209/002* (2013.01)

(58) Field of Classification Search

CPC ..... B25D 9/145; B25D 9/12; E21B 1/00; E21B 7/00; F15B 21/12

USPC ..... 173/200, 208, 210, 211

See application file for complete search history.

(56) References Cited

U.S. PATENT DOCUMENTS

| | | | | |
|---|---|---|---|---|
| 3,213,615 | A | 10/1965 | Bjornberg | |
| 3,456,744 | A | 7/1969 | Altschuler | |
| 3,470,970 | A | 10/1969 | Mahy et al. | |
| 3,490,549 | A * | 1/1970 | Catterson | 173/207 |
| 3,780,621 | A | 12/1973 | Romell | |

(Continued)

FOREIGN PATENT DOCUMENTS

| | | |
|---|---|---|
| FR | 2785347 | 5/2000 |
| GB | 1588525 | 4/1981 |

(Continued)

*Primary Examiner* — Nathaniel Chukwurah

(74) *Attorney, Agent, or Firm* — Mark P. Stone

(57) ABSTRACT

A hydraulic impact mechanism, of the valveless impact mechanism type, comprising a pre-charged gas accumulator connected to a working chamber in order to make possible impact mechanisms for equipment for rock drilling and hydraulic breakers that is lighter, cheaper and more sustainable from the point of view of material fatigue. Furthermore, a gas accumulator of piston type with an integral brake chamber (240, 250, 360) and a piston (220, 320) designed to fit into the said brake chamber (240, 250, 360).

20 Claims, 2 Drawing Sheets

(56) References Cited

U.S. PATENT DOCUMENTS

| | | | | | |
|---|---|---|---|---|---|
| 3,903,972 | A | * | 9/1975 | Bouyoucos et al. | 173/208 |
| 3,911,789 | A | * | 10/1975 | Bouyoucos | 91/321 |
| 4,039,033 | A | * | 8/1977 | Salmi | 173/105 |
| 4,282,937 | A | | 8/1981 | Hibbard | |
| 5,540,052 | A | | 7/1996 | Sieke et al. | |
| 6,953,098 | B2 | | 10/2005 | Kriesels et al. | |
| 2010/0155096 | A1 | | 6/2010 | Morrison | |

FOREIGN PATENT DOCUMENTS

| | | |
|---|---|---|
| GB | 2179381 | 3/1987 |
| SU | 1068591 | 1/1984 |
| WO | WO 2008/085114 | 7/2008 |

* cited by examiner

HYDRAULIC IMPACT MECHANISM FOR USE IN EQUIPMENT FOR TREATING ROCK AND CONCRETE

TECHNICAL AREA

The present invention relates to a hydraulic impact mechanism of the type known as 'gate valveless' or 'valveless', to be used in the equipment for treating rock and concrete, and to drilling and hammering equipment that comprises such impact mechanisms. Furthermore, it relates to a gas accumulator and to components of such an accumulator, for connection to a working chamber in a valveless hydraulic impact mechanism.

BACKGROUND

Percussion, rotation, and percussion with simultaneous rotation variants of equipment for the treatment of rock and concrete are available. It is well known that the impact mechanism in such equipment is driven hydraulically. A hammer piston, mounted such that it can move in a cylinder bore in a machine housing, is then exposed to alternating pressure such that a reciprocating motion of the hammer piston in the cylinder bore is achieved. The alternating pressure is most often obtained through a separate switch-over valve, normally of gated type and controlled by the position of the hammer piston in the cylinder bore, couples alternately to at least one of two drive chambers, formed between the hammer piston and the cylinder bore, to a line in the machine housing with driving fluid, normally hydraulic fluid, under pressure, and subsequently to a drainage line for driving fluid in the machine housing. A periodically alternating pressure arises in this manner, with a periodicity that corresponds to the impact frequency of the impact mechanism.

The manufacture of gate valveless impact mechanisms, also known as valveless mechanisms, has also been known for more than 30 years. Instead of having a separate switch-over valve, the hammer piston in valveless impact mechanisms is caused to perform also the work of the switch-over valve through it opening and closing for the supply and drainage of driving fluid under pressure during its motion in the cylinder bore in a manner that provides an alternating pressure as described above, in at least one of two drive chambers separated by a drive part of the hammer piston. One condition required for this to work is that channels, arranged in the machine housing for the pressurisation and drainage of a chamber, open out into the cylinder bore such that the openings are separated in such a manner that short-circuiting connection does not arise directly between supply channel and drainage channel at any position of the reciprocating motion of the piston. The connection between the supply channel and the drainage channel is normally present solely through the gap seal that is formed between the drive part and the cylinder bore. If this were not the case, large losses would arise, since driving fluid would be allowed to pass directly from high-pressure pump to tank without any useful work being carried out.

In order for it to be possible for the piston to continue its motion from the moment at which a channel for the drainage of a drive chamber is closed until a channel for pressurisation of the same drive chamber is opened, it is necessary that the pressure in the drive chamber is changed slowly as a consequence of a change in volume. This can take place through the volume of at least one drive chamber being made large relative to what is normal for traditional impact mechanisms of gate valve type. It is necessary that the volume be large since the hydraulic fluid that is normally used has a low compressibility. We then define the compressibility, $\kappa$, as the ratio between the relative change in volume and the change in pressure, as follows: $\kappa=(dV/V)/dP$. It is, however, more usual to use the modulus of compressibility, $\beta$, which is the inverse of the compressibility as we have defined it above, as a measure of compressibility. Thus $\beta=dP/(dV/V)$. The units of measurement of the modulus of compressibility are Pascal.

The volume is to be sufficiently large that the pressure in the chamber during the change in volume that the chamber experiences during the motion of the hammer piston towards the opening of the channel for pressurisation of the chamber will not be sufficiently large to reverse the motion of the piston before the channel has opened.

A valveless hydraulic impact mechanism with two drive chambers is known through U.S. Pat. No. 4,282,937, where the pressure alternates in both of these chambers. Both drive chambers have large effective volumes through them being in continuous connection with volumes lying close to the cylinder bore.

A valveless hydraulic impact mechanism according to another principle is known through SU 1068591 A, namely with alternating pressure in the upper drive chamber and constant pressure in the lower, which is the drive chamber that lies most closely to the connection for the tool. In this case, the upper drive chamber, which is the one in which the pressure alternates, has a considerably larger volume than the lower drive chamber, in which the pressure is constant.

One problem with large drive chambers in which the pressure continuously alternates between system pressure and return pressure, i.e. approximately atmospheric pressure, is that the machine housing itself tends to suffer from the formation of cracks as a consequence of material fatigue. In order to avoid this, designs that have thick and complex castings with intermediate walls have until now been required, with a high cost and weight that follow from this.

The Purpose of the Invention and its Most Important Characteristics

One purpose of the present invention is to reveal a design of valveless hydraulic impact mechanisms that provides the possibility of counteracting the problem described above, and to make possible lighter and at the same time more robust designs with respect to the formation of cracks in the machine housing itself. This is achieved with the means that are described in the independent claims. Further advantageous embodiments are described on the non-independent claims.

SU 1068591 reveals not only an alternative embodiment consisting of constant pressure in the lower drive chamber and alternating pressure in the upper. In addition to this, two accumulators are introduced directly connected to the drive chamber with alternating pressure. The intention of this is to improve the efficiency. Our problem concerning the formation of cracks in the machine housing due to material fatigue is not mentioned at all. Further, it is obvious that the membrane accumulators that are described in SU 1068591 must have very limited lifetime, since the membrane will reach the bottom of the accumulators with the impact frequency. This does not constitute a design that can be used in practice.

It has, however, proved to be so that a gas accumulator connected directly to a working chamber in a hydraulic impact mechanism for rock drilling or in a hydraulic breaker for demolition has a significant positive influence with respect to the risk of material fatigue and the subsequent risk of the formation of cracks in the casing. The invention constitutes a solution of this type. In order for the gas accumulator to withstand the extremely severe conditions with pulsations of pressure between system pressure, for example 250 bar, and return pressure, for example 5 bar, and with frequencies of magnitude up to 150 Hz, it is necessary that the elastic membrane be replaced by a solid body such as a piston mounted with reciprocating motion in a cylinder bore inside a gas accumulator.

It is furthermore advantageous that the gas accumulator have means for braking the accumulator piston, at least before it reaches one of its turning points. Such a means may be a brake chamber, in which the accumulator piston is allowed to run with high-precision tolerance, such as less than 0.1 mm, preferably 0.05 mm.

The invention provides a solution that may be applied not only to impact mechanisms that have alternating pressure on only one side, but also with such that have alternating pressures on both sides. A gas accumulator is connected to each of the drive chambers in the latter case.

One preferred embodiment, however, constitutes an impact mechanism working with constant pressure in one chamber, normally achieved through the chamber being connected during the complete stroke cycle, or at least during essentially the complete stroke cycle, to a source of constant pressure, most often directly to the source of the system pressure or the impact mechanism pressure.

Impact mechanisms of the type that is described above may be part of an integrated part of equipment for treating rock and concrete, such as rock drills and hydraulic breakers. These machines and breakers should most often be mounted during operation on a carrier that may comprise one or more of the following means: means for alignment, means of positioning, and means for feeding the drill or breaker against the treated rock or concrete elements, and further, means for guiding and monitoring the treatment process. Further, means for the propulsion and guidance of the carrier itself are comprised. Such a carrier may be a rock drill rig.

DETAILED DESCRIPTION OF PREFERRED EMBODIMENTS

A number of designs of the invention are described below as examples, with reference to the attached drawings. The protective scope of the invention is not to be considered to be limited to these embodiments: it is defined by the claims.

Figure 1:
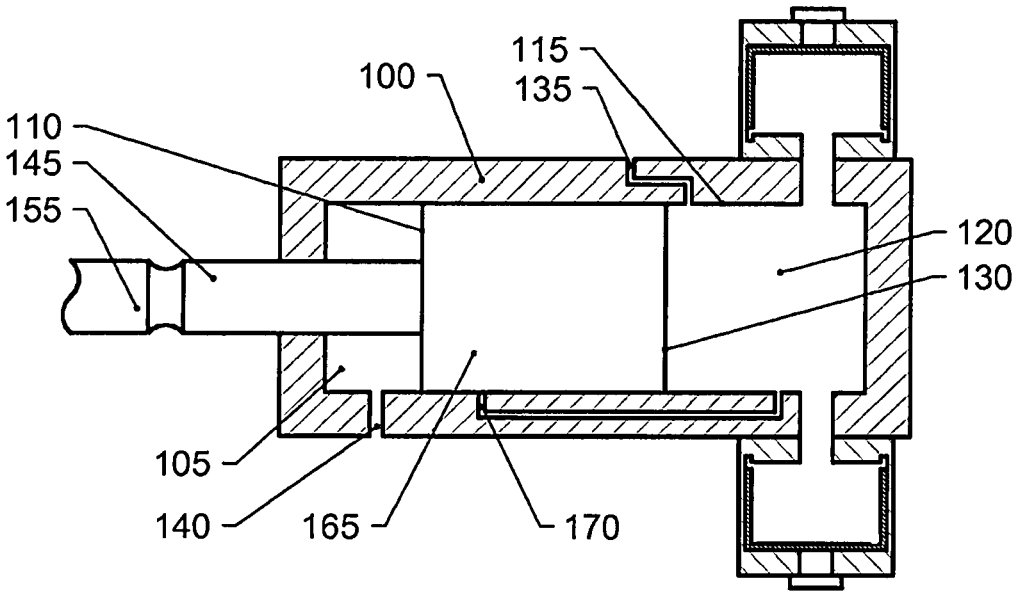
FIG. 1 shows a sketch of the principle of a hydraulic impact mechanism with alternating pressure in the chamber at the right.
Figure 2:
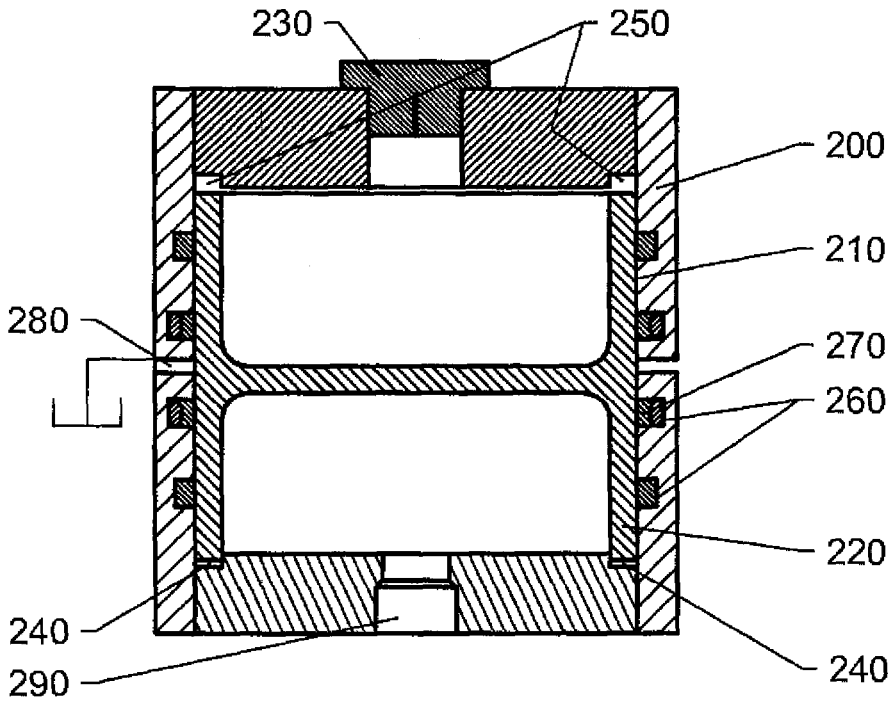
FIG. 2 shows a gas accumulator of piston type with brake chambers at the two turning points of the accumulator piston.
Figure 3:
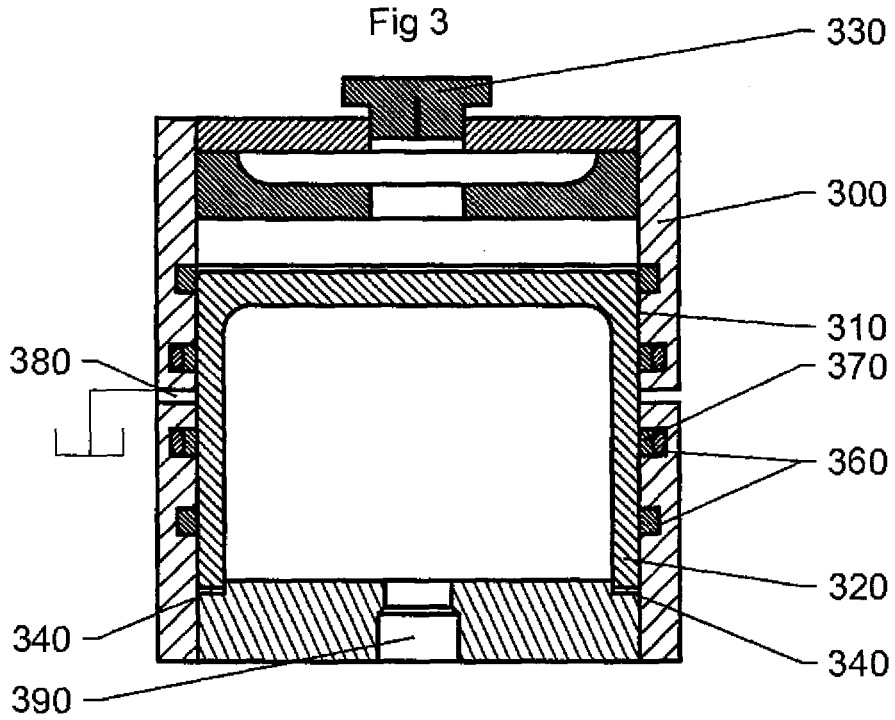
FIG. 3 shows a gas accumulator of piston type with brake chambers at the turning point of the accumulator piston on the hydraulic side.

FIG. 1 shows schematically a hydraulic impact mechanism with alternating pressure on the upper side of the piston and constant pressure on its lower side, i.e. the side that is facing towards the connected tool. The piston 165, having a piston rod 145, 155, reciprocates within a bore 115 of a piston cylinder 100. The piston has drive surfaces 110 and 130. The first drive chamber 105 is connected to system pressure, for example 250 bar, through pressure channel 140. As FIG. 1 has been drawn, the second chamber 120 at the moment depicted in the drawing is connected to return pressure through the return channel 135. The force that acts upon the drive surface 110 will, in this way, drive the hammer piston to the right. This leads to the channel 135 being closed and a pressure starting to build up in the chamber 120. Since the pressure is built up slowly, the piston will reach sufficiently far for the connection channel 170 to open the connection between the drive chambers 105 and 120, and the system pressure becomes prevalent in the second chamber 120. Since the drive surface 130 is greater than the drive surface 110, the hammer piston will now be driven to the left. The connection channel 170 is in this way first closed, and the return channel is later opened, and the pressure in the second chamber 120 falls. A new cycle thus commences with the piston again being driven to the right by the system pressure acting on the drive surface 110.

It is not now necessary that the drive chambers be large, since the compressibility arises from both of the pre-charged gas accumulators. The dimensions of the chamber 120 are set based on space requirements for the channels and the connections to the gas accumulators. A volume that would be several litres without the gas accumulators will now become as small as approximately 1 decilitre.

A working machine may have the following essential dimensions:

The diameter of the hammer piston at the drive part: 44 mm. Diameter of the piston rod: 36 mm. Length of the drive part: 100 mm. Distance from the right edge of the return channel 135 at the opening in the cylinder bore to the corresponding left edge of the left opening of the connection channel 170: 93 mm. Weight of piston: 4.5 kg. System pressure: 230 bar. And finally, the total volume of each of the accumulators: 90 cubic centimetres, with a pre-charging pressure of $190\times10^5$ Pa for one accumulator and $15\times10^5$ Pa for the second.

If only one accumulator is used, the volume will be 74 $cm^3$.

Pre-charging of the gas pressure of the accumulators takes place through the connection 230, 330. The connection to the hydraulic fluid in the working chamber takes place through 290, 390.

It is advantageous to have grooves 260, 360 for seals 270, 370 formed in the cylinder bore 210, 310 of the cylinders 200, 300 of the accumulators.

It is advantageous to introduce a drainage channel 280, 380 between the seals in order to avoid the mixing of gas and oil.

Brake chambers 240, 250, 340 are designed in the accumulator housing. The accumulator piston 220, 320 is received in these brake chambers in such a manner that the speed is reduced before the change of direction. This increases considerably the lifetime of the accumulator piston.

From the point of view of efficiency it is advantageous to have double accumulators connected, as described above. One is a high-pressure accumulator with a pre-charging pressure that is less than the system pressure, and the other is a low-pressure accumulator with a pre-charging pressure that is greater than the return pressure, but much less than the system pressure.

The invention claimed is:

1. A hydraulic impact mechanism for use in equipment for the treatment of rock and/or concrete, said mechanism comprising a machine housing with a first cylinder bore, a piston that is mounted such that it can be displaced in the first cylinder bore such that it repeatedly executes a reciprocating motion relative to the machine housing during operation for exerting impacts either directly or indirectly onto a tool for the treatment of rock or concrete and is connectable to the equipment, and wherein the piston includes a drive part that separates a first drive chamber and a second drive chamber formed between the piston and the machine housing, and wherein the first and second drive chambers are arranged such that they contain a driving medium under pressure during operation, and wherein furthermore the machine housing includes channels that open out into the first cylinder bore and are arranged to contain driving medium during operation and to, with the aid of the piston during its motion in the first cylinder bore, open and close into at least the second drive chamber such that at least the second drive chamber acquires periodically alternating pressure for the maintenance of the reciprocating piston motion, and that positions for the openings of the channels are axially arranged along the first cylinder bore so as to be opened and closed by portions of said reciprocating piston for holding the second drive chamber closed for the supply or drainage of driving medium that is present in the second drive chamber along a distance between the opening of a first channel in association with a first turning point of the piston and the opening of a second channel in association with a second turning point for the piston, and that the motion of the piston along said distance takes place during compression or expansion of the volume of the second drive chamber, wherein the magnitude of the volume of the second drive chamber is adapted to obtain a slow change of pressure along said distance, such that the hydraulic impact mechanism provides a valveless hydraulic impact mechanism, wherein said second drive chamber comprises a gas accumulator during operation, said gas accumulator comprising a second cylinder bore with an accumulator piston mounted such that said accumulator piston is displaceable in the second cylinder bore, wherein said accumulator piston separates the driving medium in the second drive chamber from a gas under pressure contained in a closed compartment of the gas accumulator, and wherein the volume of said closed compartment varies with the frequency of the impact mechanism during operation as a consequence of the reciprocating motion of the accumulator piston in the second cylinder bore.

2. This hydraulic impact mechanism according to claim 1, wherein the gas accumulator includes a brake chamber for accelerating the braking of the accumulator piston before the turning point of the accumulator piston.

3. This hydraulic impact mechanism according to claim 2, wherein the accumulator piston and the brake chambers are designed such that, when the accumulator piston enters a brake chamber, a gap of width less than 0.5 mm arises between them, said gap constituting a gap seal between the brake chamber and the second drive chamber.

4. The hydraulic impact mechanism according to claim 3, comprising at least two sealing elements for sealing between the accumulator piston and the second cylinder bore.

5. The hydraulic impact mechanism according to claim 2, comprising at least two sealing elements for sealing between the accumulator piston and the second cylinder bore.

6. A rock drill comprising the hydraulic impact mechanism according to claim 2.

7. A hydraulic breaker comprising the impact mechanism according to claim 2.

8. The hydraulic impact mechanism according to claim 1, comprising at least two sealing elements for sealing between the accumulator piston and the second cylinder bore.

9. The hydraulic impact mechanism according to claim 8, wherein the second cylinder bore comprises at least two grooves for the mounting of said sealing elements.

10. The hydraulic impact mechanism according to claim 9, wherein the gas accumulator comprises a channel that opens out into the second cylinder bore between the two sealing elements for drainage of driving medium to a tank for driving medium.

11. The hydraulic impact mechanism according to claim 8, wherein the gas accumulator comprises a channel that opens out into the second cylinder bore between the two sealing elements for drainage of driving medium to a tank for driving medium.

12. A rock drill comprising the hydraulic impact mechanism according to claim 1.

13. A carrier comprising the rock drill according to claim 12, said carrier further comprising one or several of the following: an alignment element, a positioning element, and a feeder for feeding the drill or hydraulic breaker against the treated rock or concrete elements.

14. The rock drill rig comprising the rock drill according to claim 12.

15. A hydraulic breaker comprising the impact mechanism according to claim 1.

16. A carrier comprising the hydraulic breaker according to claim 15, said carrier further comprising one or several of the following: an alignment element, a positioning element, and a feeder for feeding the drill or hydraulic breaker against the treated rock or concrete elements.

17. A gas accumulator housing for connecting a gas accumulator to a working chamber in an hydraulic impact mechanism according to claim 1, said gas accumulator housing containing during operation a driving medium under pressure, wherein said pressure continuously pulsates between system pressure and return pressure, said gas accumulator housing comprising said second cylinder bore for the mounting of said accumulator piston for reciprocating motion in said second cylinder bore, said gas accumulator housing further comprising a brake chamber for receiving the accumulator piston leading to braking of the accumulator piston before one of said turning points.

18. An accumulator piston for mounting in a gas accumulator housing according to claim 17, the accumulator piston comprising a part for penetration into said brake chamber with a gap of magnitude less than 0.1 mm.

19. A gas accumulator comprising the accumulator piston according to claim 18.

20. A gas accumulator comprising the gas accumulator housing according to claim 17.

* * * * *